United States Patent [19]

Fisher

[11] Patent Number: 4,552,039

[45] Date of Patent: Nov. 12, 1985

[54] NUT AND WASHER HOLDING ADJUSTABLE WRENCH

[76] Inventor: George W. Fisher, 5915 Daybreak Ter., Baltimore, Md. 21206

[21] Appl. No.: 583,191

[22] Filed: Feb. 24, 1984

[51] Int. Cl.[4] ..... B25B 13/52

[52] U.S. Cl. ..... 81/64; 294/100

[58] Field of Search ..... 81/13, 64, 91 R, 91 A, 81/125; 294/100, 99 R

[56] References Cited

U.S. PATENT DOCUMENTS

| | | | |
|---|---|---|---|
| 1,550,436 | 8/1925 | Hall | 81/125 |
| 2,302,691 | 11/1942 | Green | 294/100 |
| 2,553,479 | 5/1951 | Schmarje et al. | 294/100 |
| 4,327,610 | 5/1982 | Chiarenza | 81/64 |

FOREIGN PATENT DOCUMENTS

| | | | |
|---|---|---|---|
| 472667 | 9/1937 | United Kingdom | 294/100 |

*Primary Examiner*—James L. Jones, Jr.
*Attorney, Agent, or Firm*—John F. McClellan, Sr.

[57] ABSTRACT

A wrench system provides for resiliently holding a nut periphery between opposed jaws and holding washer axially of the nut between arms at right angles to the jaws and with the jaws between the arms; adjustment of inter-jaw spacing is provided by a first sliding member carrying past an extended portion of each jaw at an inclined angle thereto respective provisions urging it inward toward the other jaw or outward away from it, depending on direction of sliding; convolutions in the extended portions of the jaws provided for step setting of jaw spacing; a second sliding member carries the washer holding arms into position for washer holding in alignment with a nut held by the wrench system, or away from that position to provide clear access for nut loading; a headed screw fixes the first and second sliding members in selected relation to the handle.

8 Claims, 4 Drawing Figures

NUT AND WASHER HOLDING ADJUSTABLE WRENCH

FIELD OF THE INVENTION

This invention relates generally to hand tools and specifically to an open-end nut-and-washer holding wrench.

SUMMARY OF THE INVENTION

Nut and washer holding end-wrenches are known. However, it is believed that an open-end wrench system with symmetrically adjustable jaws and means for carrying a nut alone, or a washer and a nut, as selected by manipulation of a handle, has not until the present been available, and to provide such is an object of this invention.

Another object is to provide such a system that is suited for specialized assembly applications and for general home use as well.

Further objects are to provide a system as described that is convenient to use, can be set in steps of jaw spacing, can clear the washer-holding portion away from the nut jaws when not in use, can be used in any orientation.

Still further objects are to provide a system as described that provides for simultaneous locking or fixing, at the handle, of the adjustments provided, that requires a minimum of parts, and those relatively rugged, and that is economical and durable.

BRIEF DESCRIPTION OF THE DRAWINGS

The above and other objects and advantages of this invention will become more readily apparent on examination of the following description including the drawings in which like reference numerals refer to like parts.

DETAILED DESCRIPTION

Figure 1:
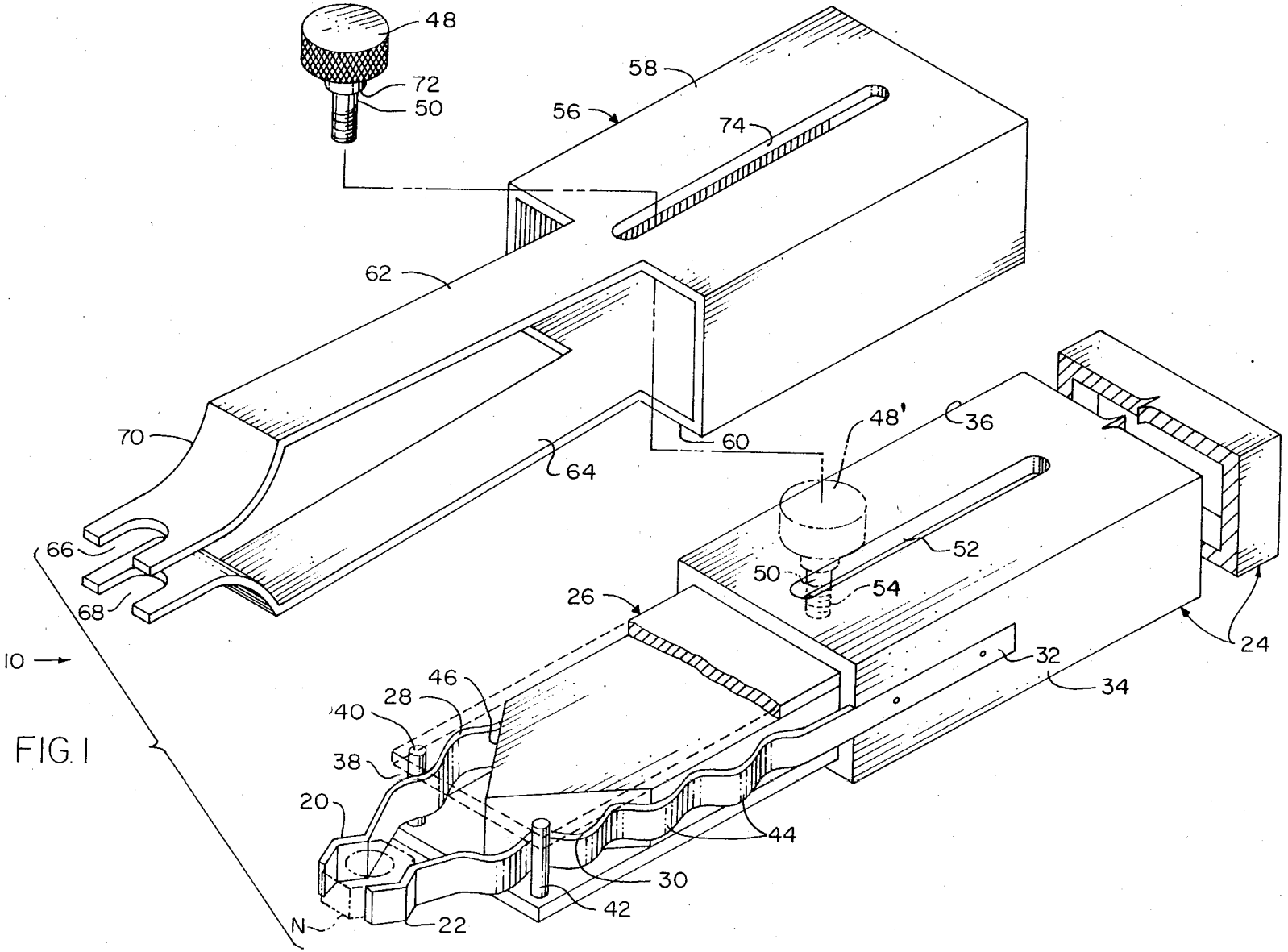
FIG. 1 is an exploded view of the wrench system in a preferred embodiment; the view is broken in parts for clarity.

FIG. 1 shows the invention in embodiment 10, an adjustable open-end wrench with nut and/or washer holding capabilities. A nut N is held between first and second jaws 20, 22 that are in the shape of two opposed "V"'s. The invention provides a remote control to adjust the inter-jaw spacing for holding a nut. Elongate handle 24 is a square tube preferably and has first member 26 slidable within the handle in longitudinal direction to open and close the jaws 20, 22, as follows.

The jaws 20, 22, have as cam surfaces respective resilient portions 28, 30 extending at an opening angle from the jaw to flush affixation at the ends, 32 shown, by welds or screws, to respective sides 34, 36 of the handle. First member 36, which may be generally rectangular in section, has outboard of each resilient portion 28, 30 in a recess 38 through which the resilient portions pass, a respective upright camming post 40, 42 or equivalent part. Each camming post 40, 42 is spaced from the other camming post across the first member a distance effectively less than the distance between the fixed ends, 32 shown. When the posts 40, 42 are drawn away from the jaws 20, 22 by retraction of first member 26 farther into the handle 24, contact between the posts 40, 42 and resilient portions 28, 30 symmetrically forces the jaws together, and vice versa. Lateral protrusion of the jaws is compactly divided between them during adjustment and use. Preferably, the resilient portions 28, 30 have convolutions 44 along them providing stable positions or step adjustment in any predetermined steps within the relative dimensions of the parts.

Preferably the jaws and resilient portions are integral and of spring-tempered steel strap. Parts not otherwise specified may be of steel. Portions 44 are opposed.

Preferably, also within the recess 38 is a V-shaped or inclined-side protrusion 46 or tensor bar provided as part of the first member 26 in position to contact and support the resilient portions 28, 30 and to spread them if necessary during the sliding adjustments of the jaws.

Sliding position of the handle 24 and first member 26, and thus the inter-jaw spacing, is fixed, when desired, by a shoulder screw 48, shown in phantom at 48' also, with shank 50 passing through slot 52 in the handle and threaded into a hole 54 tapped in the first member. The handle is considerably longer than shown, to provide a full hand grip regardless of sliding position of the elements.

Slidable on the outside of the handle 24 is washer holder or second member 56, a length of preferably rectangular-section tubing that preferably substantially surrounds and slidably fits the handle 24 just as the handle preferably substantially surrounds and slidably fits the first member 26, both with a smooth running-fit.

Extending forwardly, or toward the jaw end of the wrench system, from the center of the second member top 58 and bottom 60 respectively is a pair of arms 62, 64. Each arm has a respective end slot 66, 68 for receiving a bolt or other such fastener passing through the jaws, as for enngaging a nut in the jaws. The offsets are not necessarily as great in extent as shown.

A washer may be held between either arm 62, 64 and the jaws 20, 22 which are at right angles between the arms. Not necessarily preferred but a useful variation for clearance in some applications would be a second member with only one arm. This embodiment could be manually rotated about the long axis when desired to apply a washer overhead or beneath or at any varied location. A second slot 74 might be provided.

Preferably each arm is offset inwardly at the slotted end and the offset forms a smooth arc offset 70 for smoother passage over the jaws, toward which the arms are biased, when the arms and second member are slid toward the position for holding a washer, or rearwardly away to clear the nut holding position. Slot 74 along the top longitudinal centerline to match the slot in the handle, provides for passage of the shank 50 of screw 48, the shoulder 72 of which can tighten handle 24 and first and second members 26, 56 in selected relative position simultaneously.

The second member and arms may be made integrally of steel, with the arms spring tempered, or otherwise conventionally fabricated.

The slotted ends of the second member 56 may extend beyond the jaws and be biased to touch each other, if desired, so that a washer carried between them can be inserted over a bolt in a remote location where there is no need to have also a nut in the jaws.

It will be appreciated that the fitted, inter-sliding parts could be of a cross-sectional shape other than rectangular, although rectangular-section combines good fit, strength and stiffness, with simplicity in construction, and permits use of loose tolerances.

Figure 2:
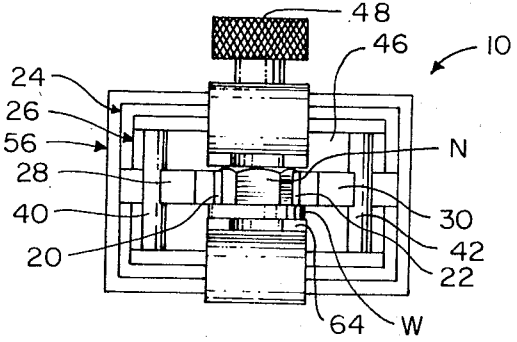
FIG. 2 is an end elevational view thereof assembled.

FIG. 2 shows embodiment 10 in front-end elevational view. The handle shows at 24, the first member at 26, and the second member at 56.

Nut N is held between jaws 20, 22. Resilient portions extending back from the jaws show at 28, 30 and posts at 40, 42. Washer W is held between second arm 64 and the jaws 20, 22. Protrusion of the first member between the resilient portions 28, 30, shows at 46. Knurled head shoulder-screw shows at 48.

Figure 3:
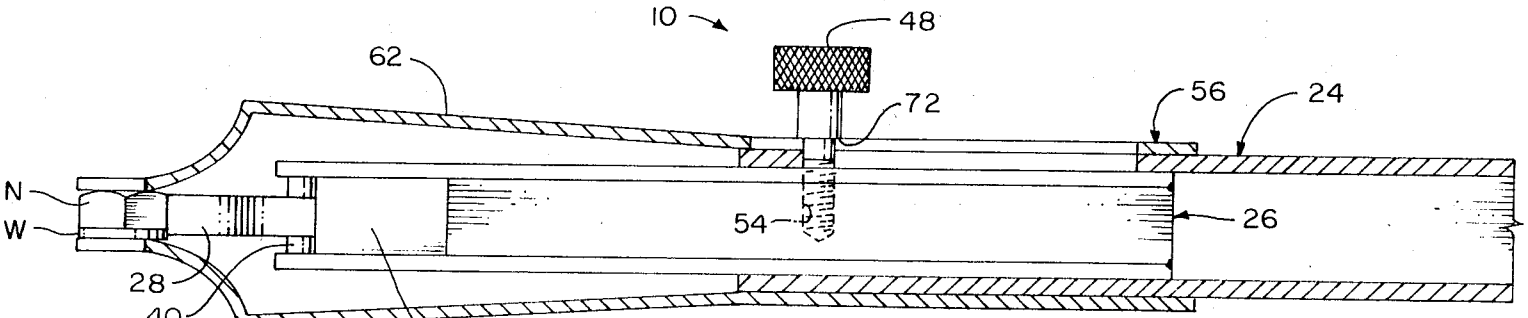
FIG. 3 is a longitudinal section therethrough showing a nut and a washer being held.

FIG. 3 shows nut N, washer W, resilient portion 28, post 40, protrusion 46, arms 62, 64, screw 48 in tapped hole 54 with shoulder 72 fixing in place the sliding relation of the handle 24, first member 26 and second member 56.

Figure 4:
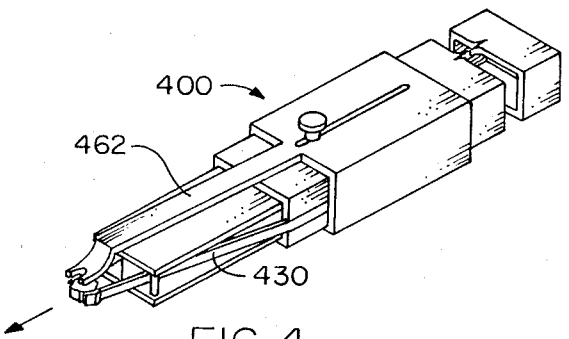
FIG. 4 is a perspective view completely assembled, of a second embodiment like the first except that cam surfaces on the jaw structure are straight instead of convoluted and only one washer-holding arm is embodied.

FIG. 4 shows embodiment 400 demonstrating (a) full assembly, (b) use of straight or non-convoluted resilient portions, 430 shown, for infinite-increment adjustment, and (c) use of only one arm, 462 shown, for more compact dimensions, which some applications may require. Control is through 48, 56, 24.

This invention is not be be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a wrench system having means for adjustably holding a nut, means for holding a washer in alignment with the nut for attachment of the washer and nut on a fastener such as a bolt, and a longitudinally extending handle portion, the improvement comprising: the means for adjustably holding a nut including: first and second jaws, means resiliently spacing the first and second jaws relative to each other; said means for holding a washer including: at least a first arm, means for biasing the first arm toward said first and second jaws, said first arm having a slotted end for receiving a said fastener therein, said means for resiliently spacing the first and second jaws relative to each other comprising: said first and second jaws having respective resilient portions thereof extending to and affixed to said longitudinally extending handle portion, a first member slidable relative to said longitudinally extending handle portion, the first member having a protrusion between said respective resilient portions, a respective part of the first member outboard each respective resilient portion; a second member slidable relative to said longitudinally extending handle portion, said means for biasing the first arm toward said first and second jaws, including said first arm being resilient and affixed to said second member; means for fixing the slidable position of said first member and of said second member relative to said longitudinally extending handle portion, the longitudinally extending handle portion substantially surrounding the first member, the second member substantially surrounding the longitudinally extending handle portion, and the means for fixing the slidable position being a headed screw extending through respective slots in said second member and said longitudinally extending handle portion and threaded into said first member.

2. In a wrench system having means for adjustably holding a nut, means for holding a washer in alignment with the nut for attachment of the washer and nut on a fastener such as a bolt, and a longitudinally extending handle portion, the improvement comprising: the means for adjustably holding a nut including: first and second jaws, means resiliently spacing the first and second jaws relative to each other; said means for holding a washer including: at least a first arm, means for biasing the first arm toward said first and second jaws, said first arm having a slotted end for receiving a said fastener therein, said means for resiliently spacing the first and second jaws relative to each other comprising: said first and second jaws having respective resilient portions thereof extending to and affixed to said longitudinally extending handle portion, a first member slidable relative to said longitudinally extending handle portion, the first member having a protrusion between said respective resilient portions, a respective part of the first member outboard each respective resilient portion; said resilient portion affixation being to respective sides of said longitudinally extending handle portion, and the distance between said respective parts of the first member outboard each respective resilient portion being less than the effective distance between said affixations of said resilient portions to said respective sides of the longitudinally extending handle portion whereby said sliding of the first member relative to the longitudinally extending handle portion adjusts said spacing between the jaws.

3. In a system as recited in claim 2, and means for providing step-settings in said spacing adjustment, comprising said resilient portions being convoluted adjacent said first member parts.

4. In a system as recited in claim 2, said means for resiliently spacing being means for symmettrically resiliently spacing.

5. In a wrench system having means for adjustably holding a nut, means for holding a washer in alignment with the nut for attachment of the washer and nut on a fastener such as a bolt, and a longitudinally extending handle portion, the improvement comprising: the means for adjustably holding a nut including: first and second jaws, means resiliently spacing the first and second jaws relative to each other; said means for holding a washer including: at least a first arm, means for biasing the first arm toward said first and second jaws, said first arm having a slotted end for receiving a said fastener therein, said means for resiliently spacing the first and second jaws relative to each other comprising: said first and second jaws having respective resilient portions thereof extending to and affixed to said longitudinally extending handle portion, a first member slidable relative to said longitudinally extending handle portion, the first member having a protrusion between said respective resilient portions, a respective part of the first member outboard each respective resilient portion, said first member protrusion having an incline adjacent each said respective first member part in a location for bearing on a respective resilient portion.

6. In a wrench system having means for adjustably holding a nut, means for holding a washer in alignment with the nut for attachment of the washer and nut on a fastener such as a bolt, and a longitudinally extending handle portion, the improvement comprising: the means for adjustably holding a nut including: first and second jaws, means resiliently spacing the first and second jaws relative to each other; said means for holding a washer including: at least a first arm, means for biasing the first arm toward said first and second jaws, said first arm having a slotted end for receiving a said fastener therein, said means for resiliently spacing the first and second jaws relative to each other comprising: said first and second jaws having respective resilient portions thereof extending to and affixed to said longitudinally extending handle portion, a first member slidable relative to said longitudinally extending handle portion, the first member having a protrusion between said respective resilient portions, a respective part of the first member outboard each respective resilient portion, a second member slidable relative to said longitudinally extending handle portion, said means for biasing the first arm toward said first and second jaws including said first arm being resilient and affixed to said second member, and a second said arm, opposed to the first arm and fixed on said second member, with said first and second jaws between the first arm and the second arm.

7. In a wrench system having means for adjustably holding a nut, means for holding a washer in alignment with the nut for attachment of the washer and nut on a fastener such as a bolt and a longitudinally extending handle portion, the improvement comprising: the means for adjustably holding a nut including: first and second jaws, means slidable on the longitudinally extending handle portion for resiliently spacing the first and second jaws relative to each other; said means for holding a washer including first and second arms at right angles to said first and second jaws, means for biasing said first and second arms towards said first and second jaws, each of said first and second arms being offset inwardly, and having a respective slotted end therein for receiving a said fastener therein.

8. In a wrench system as recited in claim 7, said means for holding a washer slidable on the longitudinally extending handle portion, and means on the longitudinally extending handle portion for simultaneously tightening in slidable position said means for resiliently spacing and means for holding a washer.

* * * * *